US007776448B2

(12) United States Patent
Greene et al.

(10) Patent No.: US 7,776,448 B2
(45) Date of Patent: Aug. 17, 2010

(54) CONVERSION COATINGS INCLUDING ALKALINE EARTH METAL FLUORIDE COMPLEXES

(75) Inventors: Jeffrey Allen Greene, Sterling, MI (US); Donald Robb Vonk, Clinton Township, MI (US)

(73) Assignee: PPG Industries Ohio, Inc., Cleveland, OH (US)

( * ) Notice: Subject to any disclaimer, the term of this patent is extended or adjusted under 35 U.S.C. 154(b) by 0 days.

(21) Appl. No.: 12/134,561

(22) Filed: Jun. 6, 2008

(65) Prior Publication Data

US 2008/0241577 A1 Oct. 2, 2008

Related U.S. Application Data

(60) Division of application No. 10/424,302, filed on Apr. 28, 2003, now Pat. No. 7,402,214, which is a continuation-in-part of application No. 10/134,761, filed on Apr. 29, 2002, now Pat. No. 6,749,694.

(60) Provisional application No. 60/435,441, filed on Dec. 20, 2002.

(51) Int. Cl.
*B32B 9/00* (2006.01)

(52) U.S. Cl. ..... 428/469; 428/470; 428/472; 428/472.2; 428/472.3

(58) Field of Classification Search ..... 428/469, 428/470, 472, 472.2, 472.3; 106/14.05, 14.11, 106/14.12, 14.13, 14.14, 14.21
See application file for complete search history.

(56) References Cited

U.S. PATENT DOCUMENTS

| | | | | | |
|---|---|---|---|---|---|
| 3,597,283 | A * | 8/1971 | Snee | ..... | 428/628 |
| 4,306,917 | A * | 12/1981 | Oda et al. | ..... | 148/261 |
| 5,380,374 | A * | 1/1995 | Tomlinson | ..... | 148/247 |
| 6,206,982 | B1 * | 3/2001 | Hughes et al. | ..... | 148/273 |
| 2003/0221751 | A1 * | 12/2003 | Claffey et al. | ..... | 148/247 |

* cited by examiner

*Primary Examiner*—Gwendolyn Blackwell
(74) *Attorney, Agent, or Firm*—Diane R. Meyers

(57) ABSTRACT

An aqueous composition for pretreating and depositing a coating on metal substrates is provided. The coating composition includes from about 1,500 to about 55,000 ppm based on the aqueous composition of a Group IIA dissolved metal ion, from about 100 to about 200,000 ppm based on the aqueous composition of a dissolved complex metal fluoride ion wherein the metal atom is selected from Group IIIA, Group IVA, Group IVB metals, Group VA, Group VB metals; and water. The composition is free of Group IIA metal fluoride precipitate achieved by including in the composition a complex metal salt different than the salt associated with the complex metal fluoride ion, with the complex metal salt being capable of complexing free fluoride ions to prevent a precipitation reaction. A process for coating a metal substrate with such an aqueous composition is further provided.

12 Claims, No Drawings

CONVERSION COATINGS INCLUDING ALKALINE EARTH METAL FLUORIDE COMPLEXES

CROSS REFERENCE TO RELATED APPLICATIONS

This application is a divisional application of U.S. patent application Ser. No. 10/424,302 filed Apr. 28, 2003 which is a Continuation in Part application of U.S. patent application Ser. No. 10/134,761 filed Apr. 29, 2002 which claims the benefit of priority of U.S. Provisional Patent Application Ser. No. 60/435,441 filed Dec. 20, 2002.

FIELD OF THE INVENTION

The present invention relates to coating compositions for pretreating metal surfaces. More particularly, the present invention is directed to aqueous coating compositions for providing durable, adhesive and corrosion-inhibiting coatings, as well as a method for pretreating metal surfaces with such coating compositions.

BACKGROUND OF THE INVENTION

The use of protective coatings on metal surfaces for improved corrosion resistance and paint adhesion characteristics is well known in the metal finishing arts. Conventional techniques involve pretreating metal substrates with a phosphate conversion coating and chrome-containing rinses for promoting corrosion resistance. The use of such chromate-containing compositions, however, imparts environmental and health concerns due to the toxic nature associated with chromium compounds.

As a result, chromate-free conversion coatings have been developed to overcome the need for chromate-containing compositions. Such chromate-free coatings are generally based on chemical mixtures that in some way will react with the substrate surface and bind to it to form protective layers.

Chromate-free conversion coatings typically employ a Group IVB metal such as titanium, zirconium or hafnium, a source of fluoride ion and a mineral acid to regulate the pH.

For example, U.S. Pat. No. 4,338,140 to Reghi discloses a conversion coating for improved corrosion resistance which includes zirconium, fluoride, and tannin compounds, and optionally phosphate ions. U.S. Pat. No. 5,759,244 discloses conversion coatings for metal substrates including a Group IVB metal in an acidic solution with one or more oxyanions, and which specifically excludes fluoride ions from the composition.

It has been suggested to include Group IA and/or Group IIA elements into such conversion coatings. For example, U.S. Pat. No. 5,441,580 to Tomlinson discloses the use of a Group IVB metal such as titanium, zirconium or hafnium, and Group IA metal such as potassium, and a source of fluoride ions, and U.S. Pat. No. 5,380,374 to Tomlinson discloses coatings based on such Group IVB metals including a Group IIA metal such as calcium at a concentration of 50 ppm to 1300 ppm. As is recognized in the art, for example in U.S. Pat. No. 5,964,928 to Tomlinson, coatings including Group IIA metals such as calcium generate considerable scaling from alkali metal precipitates, which may inhibit formation of the continuous metal oxide matrix. Such Group IIA metals are therefore generally used in lower concentrations. Also, as recognized in the U.S. Pat. No. 5,964,928, such compositions including Group IA or Group IIA metals likely provide little if any long-range structure.

Accordingly, it would be desirable to provide a composition useful for coating metal substrates, particularly bare ferrous metals, which overcomes the environmental drawbacks of the prior art, which demonstrates excellent corrosion resistance and adherence of subsequently applied coatings, and which does not form a precipitate which may interfere with proper formation of the coating.

SUMMARY OF THE INVENTION

In accordance with the present invention, an aqueous composition for pretreating and depositing a coating on metal substrates is provided, which includes from about 1,500 to about 55,000 ppm based on the aqueous composition, of a Group IIA dissolved metal ion, such as calcium; from about 100 to about 200,000 ppm based on the aqueous composition, of a dissolved complex metal fluoride ion wherein the central atom is selected from Group IIIA, Group IVA, Group IVB, Group VA, and Group VB metals such as aluminum, silicon, zirconium, antimony, and niobium; and water, wherein the composition is substantially free of Group IIA metal fluoride precipitate. The aqueous composition desirably contains a complex-forming metal compound, such as a complex metal salt, which is different than the salt associated with the complex metal fluoride ion, with the complex metal salt being capable of complexing free fluoride ions to prevent a precipitation reaction with the Group IIA metal ion. The metal atom of the complex metal salt is desirably selected from zirconium and silicon, such as sodium metasilicate, polysilicate, Zeolites (aluminosilicates), zirconyl nitrate, titanyl sulfate, tetrafluorozirconate and tetrafluorotitanate.

In a further embodiment, the present invention includes a method of preparing an aqueous composition for treating metal substrates, which includes adding to water a complex metal fluoride compound wherein the central atom is selected from Group IIIA, Group IVA, Group IVB, Group VA and Group VB metals; adding a complex metal salt different from the complex metal fluoride compound in an amount capable of reacting with any free fluoride ions from the complex metal fluoride compound; and adding a Group IIA metal compound. The composition is substantially free of precipitated Group IIA metal fluoride.

Desirably, the Group IIA metal compound is provided in an amount of from about 2.0 to 10.0 g/L based on the aqueous composition, the complex metal fluoride compound is added in an amount of from about 1.0 to 80 g/L based on the aqueous composition, and the complex metal salt is added in an amount of from about 0.05 to about 6.0 g/L based on the aqueous composition.

In a further embodiment, the present invention is directed to a process for coating a metal substrate, which involves contacting the metal substrate with a phosphate-based composition, such as an aqueous iron phosphate solution; contacting the metal substrate with an aqueous conversion coating including a Group IIA dissolved metal ion, a dissolved complex metal fluoride ion wherein the metal atom is selected from Group IIIA, Group IVA, Group IVB, Group VA and Group VB metals, wherein the composition is substantially free of Group IIA metal fluoride precipitate; and contacting the metal surface with an aqueous solution of a rare earth metal, such as an acidic salt of cerium, like cerium nitrate.

In yet a further embodiment, the present invention is directed to a coated metal substrate, including a metal surface which has been contacted with an aqueous crystalline-forming composition including a Group IIA dissolved metal ion, a dissolved complex metal fluoride ion wherein the metal atom is selected from Group IIIA, Group IVA, Group IVB, Group VA and Group VB metals, a complex forming metal salt different from the complex metal fluoride ion, and water. The complex forming metal salt complexes free fluoride ions to provide a composition which is substantially free of Group IIA metal fluoride precipitate and is therefore useful for providing such a crystalline coating.

DETAILED DESCRIPTION OF THE INVENTION

Other than in the operating examples, or where otherwise indicated, all numbers expressing quantities of ingredients or reaction conditions used in the specification and claims are to be understood as modified in all instances by the term "about".

As indicated, the present invention is directed to aqueous compositions for pretreating and depositing crystalline and non-crystalline coatings on metal substrates. The compositions of the present invention may be utilized to improve the corrosion-inhibiting properties of metal surfaces such as iron, steel, zinc, magnesium, or aluminum, or their alloys. The compositions of the present invention can be used to replace or to supplement conventional metal treatments such as iron phosphate, zinc phosphate and chromium conversion coatings.

In one embodiment of the invention, the aqueous coating composition includes a Group IIA dissolved metal ion, a dissolved complex metal fluoride ion with the central atom selected from selected from Group IIIA, Group IVA, Group IVB, Group VA, and Group VB metals, and water. The composition according to the present invention is substantially free of Group IIA metal fluoride precipitate.

The Group IIA dissolved metal ions referred to herein are those elements included in such group in the CAS Periodic Table of the Elements as is shown, for example, in the *Handbook of Chemistry and Physics,* 63rd Edition (1983). The Group IIA metal is, in particular, an alkaline earth metal. For example, the Group IIA metal may be calcium, magnesium, beryllium, strontium or barium. Calcium is particularly useful in connection with the present invention. The Group IIA metal may be provided from any compound or composition which is easily dissolved in the aqueous composition to provide a source of Group IIA metal ion. In particular, the Group IIA metal may be provided as any of the many inorganic hydroxides or salts available, including the nitrates, sulfates, chlorides, etc. Calcium hydroxide [$Ca(OH)_2$], calcium nitrate [$Ca(NO_3)_2$], etc. are particularly useful, with calcium nitrate being particularly desirable in connection with the present invention.

The composition of the present invention further includes at least one metal compound which is capable of converting to a metal oxide upon application to the metal substrate. The metal compound which is the precursor of the formation of the metal oxide on the surface of the substrate can be any metal compound capable of converting to a metal oxide. For example, the metal compound may be selected from those elements included in Groups IIIA, IVA, IVB, VA, VB, and VIB of the CAS Periodic Table of the Elements. Examples of such useful metal compounds include silicon, boron, aluminum and tin. Additionally, the metal compound may be selected from nickel, manganese, iron and thorium, for example through the use of complex fluoride metal anions such as $NiF_6$, $MnF_6$, $FeF_4$ and $ThF_6$.

Desirably, a metal compound is selected from the Group IVA and/or Group IVB transition metals of the CAS Periodic Table of the Elements, such as those selected from the group consisting of silicon, titanium, zirconium and hafnium ions and mixtures thereof. The Group IVA and/or Group IVB metal is provided in ionic form, which is easily dissolved in the aqueous composition. The metal ions may be provided by the addition of specific compounds of the metals, such as their soluble acids and salts.

A source of fluoride ion is also included to maintain the solubility of the metals in solution. The fluoride may be added as an acid or as a fluoride salt. In particularly desirable embodiments, the metal compound is a complex metal fluoride ion, which is provided as a fluoride acid or salt of the metal. As such, the complex metal fluoride ion provides both a Group IVA and/or Group IVB metal as well as a source of fluoride to the composition. Examples of useful compositions include fluorosilicic acid, fluorozirconic acid, fluorotitanic acid, ammonium and alkali metal fluorosilicates, fluorozirconates and fluorotitanates, zirconium fluoride, and the like. Hexafluorosilicate, hexafluorozirconate, and hexafluorotitanate are particularly useful compounds.

As indicated, the pretreatment compositions of the present invention are provided as an aqueous solution. The balance of the composition, therefore comprises water. The Group IIA dissolved metal ion is present in the aqueous solution of the present invention in an amount of from about 1,500 ppm to about 55,000 ppm, preferably in an amount of from about 2,000 ppm to about 10,000 ppm. The Group IVB dissolved complex metal fluoride ion is present in the aqueous solution of the present invention in an amount of from about 100 ppm to about 200,000 ppm, preferably in an amount of from about 1,000 ppm to about 80,000 ppm.

As noted above, conversion coating compositions including Group IIA dissolved metal ions such as calcium with Group IVA and/or Group IVB complex metal compounds typically form alkali metal precipitates, which are deleterious to the coating composition. In particular, the alkaline earth metal such as calcium will typically react with excess fluoride or free fluoride ions of the complex metal fluoride ion dissolved in the aqueous solution. The Group IIA metal ion, however, imparts significant advantages to the coating composition in terms of its properties, and in particular corrosion resistance. It has been unexpectedly discovered through the present invention that conversion coating compositions can be prepared including Group IIA metal ions at higher concentrations, therefore imparting excellent properties to the composition, which coating compositions are substantially free from any Group IIA metal fluoride precipitate, which may deleteriously affect the composition.

In order to prevent such precipitation, the aqueous composition of the present invention may further include a compound which is capable of forming complex ions with any available uncomplexed fluoride ions, i.e., a complex forming metal compound such as a complex metal salt. It has been unexpectedly discovered that such a complex forming metal compound is capable of complexing free fluoride ions, and in particular free fluoride ions of the complex metal fluoride ion dissolved in the aqueous solution. By complexing such free fluoride ions, there is no excess fluoride ion dissolved in the aqueous composition for reaction with the alkaline earth metal. As such, a precipitation reaction between the Group IIA alkaline earth metal ion and any excess or free fluoride is prevented. The complex forming metal compound is desirably a complex metal salt, which is different from the Group IVB complex metal fluoride ion and different from any salt associated with the Group IVB complex metal fluoride ion.

The metal atom of the complex forming metal compound is desirably selected from the group consisting of zirconium and silicon. For example, the complexing metal may be selected from the group consisting of sodium metasilicate, polysilicate, Zeolites (aluminosilicates), zirconyl nitrate, titanyl sulfate, tetrafluorozirconate, tetrafluorotitanate. The complex forming metal compound provides the aqueous coating composition with excess metal which acts as a scavenger for the free fluoride ions present in the solutions that are used to supply the complex metal ions. In order to provide effective complexing of such free fluoride ions, the complex forming metal compound is desirably added to the solution of the aqueous coating composition prior to adding the Group IIA alkaline earth metal ion, as will be discussed in more detail with reference to the method of preparing the coating composition.

The complex forming metal compound is provided in the aqueous solution of the present invention in an amount which is capable of providing excess metal for complexing any free fluoride that is supplied by the composition containing the Group IVA and/or Group IVB complex metal fluoride salts. Desirably, the complex forming metal compound is provided in an amount of from about 50 ppm to about 6,000 ppm, preferably in an amount of from about 100 ppm to about 2,000 ppm.

In addition, the aqueous coating composition of the present invention may also contain ferrous or ferric ions in amounts of up to about 250 to 2000 ppm. When the aqueous coating compositions of the present invention are to be utilized to coat non-ferrous surfaces such as zinc-coated surfaces, ferrous or ferric ions may be added to the coating composition. Water-soluble forms of iron can be utilized as a source of the ferrous or ferric ions, and such compounds include ferrous phosphate, ferrous nitrate, ferrous sulfate, etc. When the surface to be coated is an iron surface, it may not be necessary to add any or as much ferrous or ferric ions since a portion of the iron surface is dissolved into the coating composition upon contact.

The aqueous coating compositions of the present invention generally are utilized at a pH of between about 0 to 5.0, more preferably at a pH of about 1.0 to about 5.0 depending on the method of application. More particularly, the composition may be generally maintained at a pH range of from about 1.0 to about 3.5 for use in immersion and spray applications, and at a pH range of from about 0 to about 2.0 for use in physical applications such as rollers, brushes, and the like. The pH of the solution can be adjusted by the addition of an alkali such as sodium hydroxide, potassium hydroxide, ammonium hydroxide, or sodium carbonate to increase the pH, or an acid such as a mineral acid, for example nitric acid or phosphoric acid, to reduce the pH of the composition.

The coating compositions of the present invention can be applied to substrate surfaces in any known manner, for example, by immersion, dip coating, roll coating, spraying, and the like, as well as any combination of these methods. The compositions are typically dried after application, resulting in a crystalline coating on the metal substrate.

The chemical composition of the crystalline coating is dependent upon the compounds present in the aqueous coating composition. Desirably, the resulting crystalline coating is selected from one or more of $CaSiF_6$, $CaZrF_6$, $CaTiF_6$, $Ca(BF_4)_2$, $Ca_3(AlF_6)_2$, $CaSnF_6$, $Ca(SbF_6)_2$, and $CaNbF_7$.

The present invention further provides a method of preparing the aqueous composition for treating metal substrates. In the method, the Group IVA and/or Group IVB complex metal fluoride compound as described above is added to and dissolved in an amount of water, in sufficient quantity to provide the solution with a concentration of about 100 to about 200,000 ppm of complex metal fluoride ion. Desirably, the complex metal fluoride compound is added in an amount of from about 1 to about 80 grams per liter (g/L) based on the aqueous composition.

After the complex metal fluoride compound has been added and dissolved in the water, a complex forming metal compound which is different from the complex metal fluoride compound, as described above, is added to and dissolved in the solution. The complex forming metal compound is provided in an amount which is capable of reacting and complexing with any free fluoride ions from the complex metal fluoride compound. Desirably, the complex forming metal compound is provided as a complex metal salt which is added in an amount of from about 0.1 to about 2.0 g/L based on the aqueous composition.

The Group IIA metal compound as discussed above is then added and dissolved in the solution, in an amount sufficient to provide the solution with a concentration of about 1,500 to about 55,000 ppm of Group IIA dissolved metal ion. Desirably, an amount of from about 1.5 to about 55 grams per liter (g/L) based on the aqueous composition of the Group IIA metal ion will provide such a concentration.

By adding the complex forming metal compound to the solution prior to the Group IIA metal compound, any free fluoride from the complex metal fluoride compound will be complexed by the complex forming metal compound. As such, the solution does not include any free fluoride for reaction with the alkaline earth metal of the Group IIA metal compound, thereby preventing any precipitation reaction. As such, the composition is substantially free of precipitated Group IIA metal fluoride.

During the preparation of such composition, the pH of the solution may be adjusted with known compositions as set forth above, during any step of preparation. Desirably, the pH of the solution is adjusted prior to addition of the Group IIA alkaline earth metal ion. This may be accomplished through the addition of a mineral acid such as nitric acid.

The present invention will further be described in terms of a method of treating a metal substrate with the inorganic conversion coating compositions as described above. The substrate to be coated is usually first cleaned to remove grease, dirt, or other extraneous matter. This is done by employing conventional cleaning procedures and materials. These would include mild or strong alkaline cleaners such as are commercially available and conventionally used in metal pretreatment processes. Examples of alkaline cleaners include Chemkleen 163 and Chemkleen 177, both of which are available from PPG Industries, Pretreatment and Specialty Products. Such cleaners are generally followed and/or preceded by a water rinse.

Following the optional cleaning step, the metal surface may further be treated with a surface activating agent for promoting the formation and deposition of a crystallized coating. For example, the metal surface may be treated with metal oxide strippers, etch promoters, crystallization initiators, and the like. Examples of useful compositions include fluoride containing deoxidizing solutions, acidic or alkaline pickling baths, Jernstedt salt activator solutions, and the like.

Also useful are agents that alter the rate of crystal formation of the coatings, for example by promoting metal surface oxidation or depolarization. Examples of compositions useful in this regard including hydroxylamine salts and their organic derivatives, sodium nitrite, organic nitro compounds, organic and inorganic peroxy compounds, chlorates, bromates, permanganates, and the like.

In one particularly desirable embodiment of the present invention, the metal surface is pretreated with a conventional conversion coating prior to contacting with the aqueous alkaline earth metal coating composition. For example, a phosphate-based conversion coating is desirably applied to the metal substrate. Suitable phosphate conversion coating compositions include those known in the art, such as zinc phosphate, optional modified with nickel, iron, manganese, calcium, magnesium or cobalt. Examples of useful phosphating compositions are described in U.S. Pat. Nos. 4,941,930, 5,238,506 and 5,653,790. One particularly useful phosphating composition is CHEMFOS 51, an iron phosphate conversion coating available from PPG Industries, Inc. It has been discovered that pretreatment with such a conversion coating prior to application of the aqueous alkaline earth metal coating provides improved corrosion resistance and adherence of subsequently applied coatings.

In a further embodiment of the present invention, the iron phosphate solution contains a source of stannous ion. It has been discovered that application of iron phosphate containing stannous ion prior to application of the aqueous alkaline earth metal coating compositions can provide a significant modification of the resulting coating and can impart enhanced corrosion performance and paint adhesion. The stannous ion can be present in the aqueous iron phosphate solution of the present invention in an amount ranging from 10 ppm to 500 ppm, typically in an amount ranging from 50 ppm to 150 ppm. The stannous ion can be derived from any compound or composition which is readily dissolved in the aqueous iron phosphate solution to provide a source of stannous ion. In particular, the stannous ion may be derived from any of the many inorganic salts known in the art, including, but not limited to, stannous sulfates, stannous chlorides, stannous fluorides, stannous tartrates, stannous tetrafluoroborates, and the like. Stannous fluoride and stannous chloride are particularly useful.

Following the optional cleaning and pretreatment surface activation steps, the metal surface is contacted with the aqueous coating composition as set forth above. In particular, the metal surface is contacted with the aqueous solution or dispersion of the coating composition, which includes the Group IIA dissolved metal ion, the Group IVA and/or Group IVB dissolved complex metal fluoride ion and the complex forming metal salt, in water. The aqueous solution or dispersion may be applied to the metal substrate by known application techniques as noted above, such as by immersion, dip coating, roll coating, spraying, and the like, or combinations of these techniques, such as dipping followed by spraying or spraying followed by dipping. Typically, the aqueous solution or dispersion is applied to the metal substrate at solution or dispersion temperatures ranging from ambient to about 150° F. (ambient to 65° C.). In a particular embodiment of the present invention, the aqueous solution or dispersion is applied at ambient temperatures. The contact time is generally between 10 seconds and five minutes, typically 30 seconds to 2 minutes, when dipping the metal substrate in the aqueous medium or when the aqueous medium is sprayed onto the metal substrate.

The coating weight of the pretreatment coating composition generally ranges from 1 to 23,600 milligrams per square meter ($mg/m^2$), and typically ranges from 10 to 3000 $mg/m^2$.

After contact with the aqueous coating composition, the substrate may be rinsed with deionized water, and may further involve an organic or inorganic post rinse or sealer, such as a chromate or non-chromate sealer, or an epoxy resin rinse, as is generally known in the art.

For example, the substrate may be treated with an epoxy resin composition such as that disclosed in U.S. Pat. No. 6,312,812.

In a further embodiment of the present invention, the metal surface is contacted with a rare earth metal composition after contact with the aqueous coating composition. For example, after being treated with the alkaline earth metal coating composition, the metal surface can be contacted with a rinse composition that comprises a solution that contains one or more rare earth metals solubilized or dispersed in a carrier medium, typically an aqueous medium. For purposes of the present invention, the term rare earth metal is meant to designate those elements of the lanthanide series of the Periodic Table of Elements.

Desirably, the rare earth metal rinse composition is an aqueous acidic solution of a salt of a rare earth metal. Particularly desirable are aqueous acidic salts of cerium. The anion portion of the rare earth metal salt should be such that the salt has sufficient solubility in weakly acidic media to provide a sufficient concentration of rare earth metal ions in the solution. A wide variety of salts may be employed, such as halides, nitrates, acetates, sulfates and gluconates. The nitrate salts, and in particular cerium nitrate, are particularly desirable.

The concentration of the rare earth metal ion in the solution is desirably at 50 to 5,000 ppm of rare earth metal. The pH of the aqueous rare earth metal solution is acidic, and is desirably within the range of 2.0 to 7.0, more desirably 3.0 to 6.5. Desirably, a final water rinse may be employed after contacting with the rare earth metal rinse composition. For example, a deionized water rinse can be conducted to remove excess ions from the surface. This is particularly desirable prior to painting of the surface by electrodeposition techniques.

In yet a further embodiment of the present invention, such a rare earth metal may be incorporated directly into the aqueous coating composition which includes the Group IIA dissolved metal ion, the Group IVA and/or Group IVB dissolved complex metal fluoride ion and the complex forming metal salt. For example, an acid salt of a rare earth metal, such as cerium nitrate, can be incorporated directly into the aqueous coating composition. Such a composition can then be used as a conversion coating for metal substrates as discussed above. It is noted that the substrate after coating as such can further be contacted with a separate aqueous solution including a rare earth metal, as discussed above.

As noted above, it has been unexpectedly recognized through the present invention that conversion coating compositions can be used for imparting excellent properties to the composition such as corrosion resistance, even when the compositions include Group IIA metal ions at high concentrations. It has been discovered that such high levels of Group IIA metal ions, and in particular calcium, can provide coating compositions which are substantially free from any Group IIA metal fluoride precipitate, particularly when the coating solutions include a free fluoride scavenger. Such coating compositions provide excellent results when applied to metal substrates, and can be particularly useful even at reduced exposure time with the metal substrate. As such, higher alkaline earth metal concentrations can be used for better corrosion resistance with shorter application times, without presenting precipitation problems which may deleteriously affect the coating composition.

The following examples demonstrate the preparation of coating compositions of the present invention, as well as comparisons of such coatings with prior art compositions. Unless otherwise indicated in the examples and elsewhere in the specification and claims, all parts and percentages are by weight, temperatures are in degrees Centigrade, and pressures are at or near atmospheric pressure.

EXAMPLES

Example 1

Example 1 represents a comparative example, demonstrating a conversion coating prepared in accordance with Example 1 of U.S. Pat. No. 5,441,580, including 15 g/L potassium hexafluorozirconate in distilled water, with 0.10 g $H_3BO_3$, 5 g $KF.2H_2O$, 60 ml HF, providing approximately 4876 ppm Zr.

Example 2

Example 2 represents a comparative example, demonstrating a conversion coating prepared in accordance with Example 2 of U.S. Pat. No. 5,380,374, including 1 g/L potassium hexafluorozirconate in distilled water with 148 mg calcium hydroxide and nitric acid, providing approximately 313 ppm Zr, 402 ppm F, and 80 ppm Ca.

The compositions of Example 2 and 3 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 1.

TABLE 1

| | SALT DIP PERFORMANCE (10 DAY) | | | |
|---|---|---|---|---|
| | COLD ROLLED STEEL | | | |
| | AVG. | | ELECTROGALVANIZED | |
| EXAMPLE | CREEP (mm) | MAX. CREEP (mm) | AVG. CREEP (mm) | MAX. CREEP (mm) |
| 1 | 11.8 | 19.3 | 8.0 | 14.8 |
| 2 | 9.1 | 13.0 | 7.2 | 13.7 |

Example 3

Example 3 represents a comparative example, demonstrating a coating solution prepared with a complex metal fluoride ion, and with calcium ions in the composition in an amount greater than 1,500 ppm, without a complex-forming metal salt.

A solution was prepared in deionized water as follows: Hexafluorozirconic acid (2.25 grams $H_2ZrF_6$ per liter, providing approximately 990 ppm Zr and approximately 1200 ppm F) was added to a solution containing calcium nitrate and nitric acid (2500 ppm Ca). The pH was adjusted to 2.0 with nitric acid.

A white precipitate formed as the hexafluorozirconic acid was added to the calcium solution. This precipitate consisted of calcium, zirconium, and fluoride.

Example 4

Example 4 represents a further comparative example, demonstrating a coating solution prepared with a complex metal fluoride ion, and with calcium ions in the composition in an amount greater than 1,500 ppm, without a complex-forming metal salt, with the coating prepared according to a different procedure than Example 3.

A solution was prepared in deionized water as follows: Hexafluorozirconic acid was added to distilled water (2.25 grams $H_2ZrF_6$ per liter, providing approximately 990 ppm Zr and approximately 1200 ppm F) and nitric acid was added to adjust the pH=2.0. Calcium nitrate(s) was added to this mixture (10 g per liter $Ca(NO_3)_2$ providing approximately 2,500 ppm Ca).

A white precipitate formed as the calcium nitrate dissolved in the solution. This precipitate consisted of calcium, zirconium, and fluoride.

Example 5

Example 5 demonstrates a coating solution prepared with a complex metal fluoride ion, and with metal salt different from the complex metal fluoride ion.

A solution was prepared in deionized water as follows:

The following ingredients were mixed in the order listed below to provide a stable solution with a pH=2.0.

| | |
|---|---|
| 2.25 g/l | hexafluorozirconic acid (approx. 990 ppm Zr, 1200 ppm F) |
| 27.5 g/l | nitric acid (42 Be) (approx. 18,000 ppm $NO_3$) |
| 1.0 g/l | Advera 401 (aluminosilicate—zeolite) |
| | ammonium hydroxide (28%) |

Example 6

Example 6 demonstrates a conversion coating prepared in accordance with the present invention, including hexafluorozirconic acid as a complex metal fluoride ion, calcium nitrate, and with sodium metasilicate as a complex forming metal salt.

A conversion coating solution was prepared in deionized water as follows:

The following ingredients were mixed in the order listed below to provide a stable solution with a pH=2.0.

| | |
|---|---|
| 5.5 g/l | sodium metasilicate |
| 6.0 g/l | nitric acid (42 Be) |
| 2.25 g/l | hexafluorozirconic acid (approx. 990 ppm Zr, 1200 ppm F) |
| 10.0 g/l | calcium nitrate (approximately 2,500 ppm Ca) |

Example 7

Example 7 demonstrates a conversion coating prepared in accordance with the present invention including sodium hexafluorostannate (IV) as a complex metal fluoride ion, calcium nitrate, and with sodium metasilicate pentahydrate as a complex forming metal salt.

A conversion coating solution was prepared in deionized water as follows:

The following ingredients were mixed in the order listed below to provide a stable solution with a pH=1.3:

| | |
|---|---|
| 3.0 g/l | sodium metasilicate petahydrate (approx. 1000 ppm $SiO_3$ as stabilizer) |
| 1.62 g/l | sodium hexafluorostannate (IV) (approx. 1300 ppm $SnF_6$ as primary coating anion) |
| 5.2 g/l | nitric acid (42 Be) |
| 8.75 g/l | calcium nitrate (approx. 1700 ppm Ca) |

Examples 8-14 demonstrate various conversion coatings prepared in accordance with the present invention, including varying concentrations of calcium ions in combination with a complex metal fluoride ion including zirconium as the metal atom, and aluminosilicate zeolite as a complex forming metal salt.

Example 8

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 10.25 g/l | calcium nitrate (approx. 2500 ppm Ca) |

Example 9

A conversion coating solution was prepared in deionized water as follows:

The following ingredients were mixed in the order listed below to provide a stable solution with a pH=3.0.

| | |
|---|---|
| 0.5 g/l | Advera 401 (aluminosilicate—zeolite) |
| 2.25 g/l | hexafluorozirconic acid (approx. 990 ppm Zr, 1200 ppm F) |
| 10.25 g/l | calcium nitrate (approx. 2500 ppm Ca) |

Example 10

A conversion coating solution was prepared in deionized water as follows:

The following ingredients were mixed in the order listed below to provide a stable solution with a pH=2.0.

| | |
|---|---|
| 1.0 g/l | Advera 401 (aluminosilicate—zeolite) |
| 6.0 g/l | nitric acid (42 Be) |

-continued

| | |
|---|---|
| 2.25 g/l | hexafluorozirconic acid (approx. 990 ppm Zr, 1200 ppm F) |
| 16.2 g/l | calcium nitrate (approx. 4000 ppm Ca) |

Example 11

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.0 g/l | calcium nitrate (approx. 4900 ppm Ca) |

Example 12

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |

Example 13

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |

Example 14

A conversion coating solution was prepared in deionized water as follows:

The following ingredients were mixed in the order listed below to provide a stable solution with a pH=2.0.

| | |
|---|---|
| 1.0 g/l | Advera 401 (aluminosilicate—zeolite) |
| 4.2 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) (approx. 18,000 ppm $NO_3$) |

Examples 15-21 demonstrate various conversion coatings prepared in accordance with the present invention, including varying concentrations of calcium ions in combination with a complex metal fluoride ion including zirconium as the metal atom, aluminosilicate zeolite as a complex forming metal salt, and with a further component in the composition.

Example 15

A conversion coating solution was prepared in deionized water as follows:

The following ingredients were mixed in the order listed below to provide a stable solution with a pH=2.0.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |
| 0.5 g/l | Dowfax 2A1 |

Example 16

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |
| 0.1 g/l | tin(II) chloride, dihydrate (approx. 50 ppm Sn) |

Example 17

A conversion coating solution was prepared in deionized water as follows:

The following ingredients were mixed in the order listed below to provide a stable solution with a pH=2.0.

| | |
|---|---|
| 0.375 g/l | sodium metasilicate |
| 0.125 g/l | Advera 401 (aluminosilicate—zeolite) |
| 2.0 g/l | nitric acid (42 Be) |
| 1.125 g/l | hexafluorozirconic acid (approx. 495 ppm Zr, 600 ppm F) |
| 10.25 g/l | calcium nitrate (approx. 2500 ppm Ca) |

Example 18

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |
| 10.0 ml/l | Chemseal 77 |
| 0.5 g/l | ammonium bifluoride (approx. 300 ppm F) |

Example 19

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |
| 10.0 ml/l | Chemseal 77 |

Example 20

A conversion coating solution was prepared in deionized water as follows:

The following ingredients were mixed in the order listed below to provide a stable solution with a pH=1.4.

| | |
|---|---|
| 1.0 g/l | Advera 401 (aluminosilicate—zeolite added as stabilizer) |
| 6.25 g/l | nitric acid (42 Be) |
| 2.25 g/l | hexafluorozirconic acid (approx. 990 ppm Zr, 1200 ppm F) |
| 8.0 g/l | calcium nitrate (approx. 2000 ppm Ca) |
| 2.0 g/l | hydroxylamine sulfate (approx. 800 ppm hydroxylamine added as accelerator) |
| 0.4 g/l | tin(II) chloride, dihydrate (approx. 200 ppm Sn added as coating modifier) |

Example 21

A conversion coating solution was prepared in deionized water as follows:

The following ingredients were mixed in the order listed below to provide a stable solution with a pH=2.0.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |

The compositions of Examples 5-21 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 2.

TABLE 2

| | SALT DIP PERFORMANCE (10 DAY) | | | |
|---|---|---|---|---|
| | COLD ROLLED STEEL | | ELECTRO GALVANIZED | |
| EXAMPLE | AVG. CREEP (mm) | MAX. CREEP (mm) | AVG. CREEP (mm) | MAX. CREEP (mm) |
| 5 | PD* | PD* | 7.8 | 18.2 |
| 6 | 5.4 | 6.8 | 7.4 | 16.8 |
| 7 | 7.5 | 10.4 | 5.7 | 11.7 |
| 8 | 3.2 | 5.3 | 9.1 | 19.3 |
| 9 | 2.2 | 3.2 | 9.8 | 17.2 |
| 10 | 3.8 | 7.8 | 12.5 | 22.8 |
| 11 | 4.8 | 11.3 | 10.6 | 20.3 |
| 12 | 3.8 | 7.8 | 10.5 | 22.7 |
| 13 | 2.8 | 4.7 | 7.4 | 14.3 |
| 14 | 4.4 | 10.0 | 8.7 | 17.3 |
| 15 | 5.6 | 15.7 | 5.5 | 12.3 |
| 16 | 4.2 | 9.7 | 7.8 | 15 |
| 17 | 5.5 | 10.7 | 9.5 | 15.3 |
| 18 | 3.4 | 6.8 | 12.6 | 29.8 |
| 19 | 2.7 | 4.3 | 18.0 | 32.3 |
| 20 | 7.7 | 10.6 | 6.6 | 12.0 |
| 21 | 3.8 | 7.8 | 10.5 | 22.7 |

*paint delamination

As can be seen from the results shown in Table 2, the conversion coatings of Example 5, including a complex metal fluoride ion and a metal salt different from the complex metal fluoride ion have good corrosion resistance on electrogalvanized panels. Moreover, when Examples 6-21 are compared with the prior art conversion coatings of Examples 1 and 2, the results of Examples 6-21 demonstrate that the conversion coatings of the present invention provide improved results for paint adhesion on either one or both of cold rolled steel or electrogalvanized panels.

Example 22

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |

The composition of Example 22 was used as a conversion coating for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) conditioning: the test panels were dipped into Kasil #6 solution (0.25 g/l, pH 9.8) at room temperature for 1 minute;

(d) coating: the test panels were dipped into the treatment solution, of the present example, at room temperature for 2 minutes;

(e) rinse: the test panels were rinsed with deionized water for 30 seconds;

(f) drying: the test panels were then dried with a hot air gun for approximately 10 minutes;

(g) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 3.

Example 23

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |

Example 24

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |
| 2.5 g/l | ferrous sulfate, heptahydrate (approx. 500 ppm Fe) |

The compositions of Examples 23-24 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the treatment solution, of the present example, at room temperature for 2 minutes;

(d) rinse: the test panels were rinsed with deionized water for 30 seconds;

(e) epoxy resin: the test panels were dipped into an epoxy resin composition, such as that disclosed in U.S. Pat. No. 6,312,812, at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 3.

Example 25

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |

Example 26

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |

The compositions of Examples 25-26 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the treatment solution, of the present example, at room temperature for 2 minutes;

(d) rinse: the test panels were rinsed with deionized water for 30 seconds;

(e) sealer: the test panels were dipped into a non-chrome sealer rinse ("Chemseal 77" available from PPG industries, Inc. modified with 100 ppm fluoride) at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 3.

Example 27

An iron phosphate was prepared in tap water as follows:

| | |
|---|---|
| 40 ml/l | Chemfos 51 (available from PPG Industries, Inc.) |
| 0.3 g/l | ammonium bifluoride |
| 1.5 ml/l | Chemfil Buffer (available from PPG Industries, Inc.) |
| | pH = 3.6 |

A conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr, 1200 ppm F) |
| 20.5 g/l | calcium nitrate (approx. 5000 ppm Ca) |

The compositions of Example 27 were used for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the iron phosphate treatment solution at 49° C. for 2 minutes;

(d) coating: the test panels were dipped into the conversion coating treatment solution at room temperature for 2 minutes;

(e) rinse: the test panels were rinsed with deionized water for 30 seconds;

(f) sealer: the test panels were dipped into a non-chrome sealer rinse ("Chemseal 77" available from PPG industries, Inc. modified with 100 ppm fluoride) at room temperature for 1 minute;

(g) rinse: the test panels were rinsed with deionized water for 30 seconds;

(h) drying: the test panels were then dried with a hot air gun for approximately 10 minutes;

(i) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 3.

TABLE 3

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 22 | 4.0 | 10.8 | 5.6 | 15.0 |
| 23 | 1.3 | 4.5 | 11.4 | 23.2 |
| 24 | 1.0 | 3.2 | 12.9 | 29.0 |
| 25 | 1.8 | 4.8 | 13.3 | 28.8 |

TABLE 3-continued

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 26 | 1.1 | 3.2 | 14.3 | 34.0 |
| 27 | 2.1 | 3.5 | 6.8 | 11.3 |

As can be seen from the results shown in Table 3, various processing steps, such as the use of conditioners, epoxy resin coats, and sealers, during treatment and coating of the panels provides for an improvement in the corrosion resistance for one or both of cold rolled steel or electrogalvanized panels. Moreover, the use of an iron phosphate solution prior to treatment with the conversion coating and with a non-chrome sealer after treatment with the conversion coating provides improved corrosion resistance for one or both cold rolled steel and electrogalvanized panels, as evidenced through Example 27.

Example 28

A conversion coating solution was prepared in deionized water as follows:

The following ingredients were mixed in the order listed below to provide a stable solution with a pH=2.0.

| | |
|---|---|
| 2.25 g/l | hexafluorozirconic acid (approx. 990 ppm Zr, 1200 ppm F) |
| 21.0 g/l | magnesium nitrate, hexahydrate (approx. 2000 ppm Mg) |

Example 29

A conversion coating solution was prepared in deionized water as follows:

The following ingredients were mixed in the order listed below to provide a stable solution with a pH=4.2.

| | |
|---|---|
| 2.25 g/l | hexafluorozirconic acid (approx. 990 ppm Zr, 1200 ppm F) |
| 21.0 g/l | magnesium nitrate, hexahydrate (approx. 2000 ppm Mg) |
| | ammonium hydroxide (28%) |

The compositions of Examples 28-29 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the treatment solution, of the present example, at room temperature for 2 minutes;

(d) rinse: the test panels were rinsed with deionized water for 30 seconds;

(e) epoxy resin: the test panels were dipped into an epoxy resin, such as that disclosed in U.S. Pat. No. 6,312,812, at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 4.

TABLE 4

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 28 | 3.5 | 4.5 | 11.8 | 20.3 |
| 29 | 7.4 | 11.7 | 7.4 | 11.5 |

Example 30

A conversion coating solution was prepared in deionized water as follows:

The following ingredients were mixed in the order listed below to provide a stable solution with a pH=2.0.

| | |
|---|---|
| 4.05 g/l | fluoroboric acid (50%) (approx. 2000 ppm $BF_4$) |
| 8.0 g/l | calcium nitrate (approximately 2,000 ppm Ca) |

The composition of Example 30 was used as a conversion coating for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 5.

Example 31

A conversion coating solution was prepared in deionized water as follows:

The following ingredients were mixed in the order listed below to provide a stable solution with a pH=2.0.

| | |
|---|---|
| 4.05 g/l | fluoroboric acid (50%) (approx. 2000 ppm $BF_4$) |
| 8.0 g/l | calcium nitrate (approximately 2,000 ppm Ca) |

The composition of Example 31 was used as a conversion coating for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the treatment solution, of the present example, at room temperature for 2 minutes;

(d) rinse: the test panels were rinsed with deionized water for 30 seconds;

(e) epoxy resin: the test panels were dipped into an epoxy resin, such as that disclosed in U.S. Pat. No. 6,312,812, at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 5.

TABLE 5

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 30 | 5.6 | 8.5 | NA | NA |
| 31 | 5.4 | 12.7 | NA | NA |

Example 32

A conversion coating solution was prepared in deionized water as follows:

The following ingredients were mixed in the order listed below to provide a stable solution with a pH=2.0.

| | |
|---|---|
| 1.35 g/l | zirconyl nitrate solution (14.8% Zr) (approx. 200 ppm Zr) |
| 2.25 g/l | hexafluorozirconic acid (approx. 990 ppm Zr, 1200 ppm F) |
| 8.0 g/l | calcium nitrate (approximately 2,000 ppm Ca) |

Example 33

A conversion coating solution was prepared in deionized water as follows:

The following ingredients were mixed in the order listed below to provide a stable solution with a pH=2.5.

| | |
|---|---|
| 6.7 g/l | zirconyl nitrate solution (14.8% Zr) (approx. 1000 ppm Zr) |
| 1.25 g/l | ammonium bifluoride (s) (approx. 840 ppm F) |
| 8.0 g/l | calcium nitrate (approximately 2,000 ppm Ca) |

Example 34

A conversion coating solution was prepared in deionized water as follows:

The following ingredients were mixed in the order listed below to provide a stable solution with a pH=2.5.

| | |
|---|---|
| 6.7 g/l | zirconyl nitrate solution (14.8% Zr) (approx. 1000 ppm Zr) |
| 1.25 g/l | ammonium bifluoride (s) (approx. 840 ppm F) |
| 8.0 g/l | calcium nitrate (approximately 2,000 ppm Ca) |

The compositions of Examples 32-34 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 6.

TABLE 6

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 32 | 2.3 | 6.3 | 18.9 | 29.0 |
| 33 | 4.5 | 6.5 | NA | NA |
| 34 | 4.9 | 5.9 | NA | NA |

Example 35

A conversion coating solution was prepared in deionized water as follows:

The following ingredients were mixed in the order listed below to provide a stable solution with a pH=2.3.

| | |
|---|---|
| 2.0 g/l | hexafluorosilicic acid (approx. 400 ppm Si and 1600 ppm F) |
| 6.12 g/l | calcium nitrate (approx. 1500 ppm Ca) |

Example 36

A conversion coating solution was prepared in deionized water as follows:

The following ingredients were mixed in the order listed below to provide a stable solution with a pH=2.0.

| | |
|---|---|
| 10.0 g/l | hexafluorosilicic acid (approx. 1900 ppm Si and 7900 ppm F) |
| 20.5 g/l | calcium nitrate (approx. 5000 ppm Ca) |

Example 37

A conversion coating solution was prepared in deionized water as follows:

The following ingredients were mixed in the order listed below to provide a stable solution with a pH=1.4.

| | |
|---|---|
| 4.0 g/l | hexafluorosilicic acid (approx. 800 ppm Si and 3200 ppm F) |
| 16.4 g/l | calcium nitrate (approx. 4000 ppm Ca) |
| 0.25 g/l | Advera 401 (aluminosilicate-zeolite added as stabilizer) |

Example 38

A conversion coating solution was prepared in deionized water as follows:

The following ingredients were mixed in the order listed below to provide a stable solution with a pH=1.7.

| | |
|---|---|
| 4.0 g/l | hexafluorosilicic acid (approx. 800 ppm Si and 3200 ppm F) |
| 32.8 g/l | calcium nitrate (approx. 8000 ppm Ca) |
| 0.25 g/l | Advera 401 (aluminosilicate—zeolite added as stabilizer) |

The compositions of Examples 35-38 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 7.

TABLE 7

| | SALT DIP PERFORMANCE (10 DAY) | | | |
|---|---|---|---|---|
| | COLD ROLLED STEEL | | ELECTRO-GALVANIZED | |
| EXAMPLE | AVG. CREEP (mm) | MAX. CREEP (mm) | AVG. CREEP (mm) | MAX. CREEP (mm) |
| 35 | 11.8 | 20.1 | 6.4 | 8.5 |
| 36 | 5.0 | 7.1 | 7.3 | 13.4 |
| 37 | 7.6 | 19.0 | 7.2 | 15.6 |
| 38 | 7.5 | 15.3 | 3.7 | 11.2 |

As can be seen from the above examples, the conversion coatings of the present invention provide corrosion resistance equal to or better than prior art conversion coatings.

Examples 39-42 demonstrate various conversion coatings prepared in accordance with the present invention, including varying concentrations of calcium ions, varying concentrations of zirconium, and varying concentrations of alkaline earth metals, with the coatings being applied to substrates followed by treatment with an aqueous solution of a rare earth metal.

Example 39

A conversion coating solution was prepared in deionized water as follows:

The following ingredients were mixed in the order listed below to provide a stable solution with a pH=2.0.

| | |
|---|---|
| 2.25 g/l | hexafluorozirconic acid (approx. 990 ppm Zr and 1200 ppm F) |
| 8.2 g/l | calcium nitrate (approx. 2000 ppm Ca) |

Example 40

A conversion coating solution was prepared in deionized water as follows:

The following ingredients were mixed in the order listed below to provide a stable solution with a pH=2.0.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr and 1200 ppm F) |
| 20.5 g/l | calcium nitrate(approx. 5000 ppm Ca) |

Example 41

A conversion coating solution was prepared in deionized water as follows:

The following ingredients were mixed in the order listed below to provide a stable solution with a pH=2.0.

| | |
|---|---|
| 1.0 g/l | sodium metasilicate |
| 0.125 g/l | Advera 401 (aluminosilicate—zeolite) |
| 6.0 g/l | nitric acid (42 Be) |
| 1.13 g/l | hexafluorozirconic acid (approx. 450 ppm Zr and 600 ppm F) |
| 10.25 g/l | calcium nitrate (approx. 2500 ppm Ca) |

Example 42

A conversion coating solution was prepared in deionized water as follows:

The following ingredients were mixed in the order listed below to provide a stable solution with a pH=2.0.

| | |
|---|---|
| 1.0 g/l | Advera 401 (aluminosilicate—zeolite) |
| 24.0 g/l | nitric acid (42 Be) |
| 1.13 g/l | hexafluorozirconic acid (approx. 450 ppm Zr and 600 ppm F) |
| 10.25 g/l | calcium nitrate (approx. 2500 ppm Ca) |

Separately, a cerium coating solution was prepared in deionized water, including 3.2 g/l of cerium nitrate, hexahydrate (approx. 1000 ppm Ce). The solution was stable with a pH of 4.0.

Each of the compositions of Examples 39-42 were used as conversion coatings for treating cold rolled steel and electrogalvanized panels, followed by treatment with the cerium coating solution, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the conversion coating treatment solution, of the examples, at room temperature for 2 minutes;

(d) coating: The test panels were dipped into the cerium treatment solution as set forth above, at room temperature for 1 minute;

(e) rinse: the test panels were rinsed with deionized water for 30 seconds;

(f) drying: the test panels were then dried with a hot air gun for approximately 10 minutes;

(g) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 8.

TABLE 8

| | SALT DIP PERFORMANCE (10 DAY) | | | |
|---|---|---|---|---|
| | COLD ROLLED STEEL | | ELECTROGALVANIZED | |
| EXAMPLE | AVG. CREEP (mm) | MAX. CREEP (mm) | AVG. CREEP (mm) | MAX. CREEP (mm) |
| 39 | 3.6 | 7.8 | 8.3 | 14.5 |
| 40 | 1.9 | 3.7 | 10.0 | 18.2 |
| 41 | 1.6 | 3.7 | 12.3 | 20.5 |
| 42 | 1.9 | 5.3 | 11.3 | 23.2 |

As can be seen from the above examples, the conversion coatings of the present invention provide corrosion resistance equal to or better than prior art conversion coatings, and further contacting the coated substrate with an aqueous solution of a cerium salt further improves corrosion resistance over one or both substrates. In particular, a comparison of Example 39 (which represents panels coated only with the conversion coatings of the present invention) with Examples 40-42 (which represents panels coated with the conversion coatings of the present invention followed by a cerium treatment) shows that improved corrosion resistance is imparted for cold rolled steel when a cerium post treatment is used with the conversion coatings.

Example 43

Example 43 represents a comparative example demonstrating treatment of a metal substrate with an iron phosphate solution without any subsequent conversion coating treatment.

An iron phosphate was prepared in tap water as follows:

| | |
|---|---|
| 40 ml/l | Chemfos 51 (available from PPG Industries, Inc.) |
| 0.3 g/l | ammonium bifluoride |
| 1.5 ml/l | Chemfil Buffer (available from PPG Industries, Inc.) |
| | pH = 3.6 |

Cold rolled steel and electrogalvanized panels were treated with the composition of Example 43 as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the iron phosphate treatment solution of the present example at 49° C. for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 9.

Example 44

Example 44 represents a comparative example demonstrating treatment of a metal substrate with an iron phosphate solution and with an aqueous cerium solution without any conversion coating treatment.

In Example 44, cold rolled steel and electrogalvanized panels were treated with the iron phosphate of Example 43, followed by treatment with the cerium coating solution from Examples 39-42, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;
(b) rinsing: the test panels were then rinsed with tap water at room temperature for 15-30 seconds;
(c) coating: the test panels were dipped into the iron phosphate treatment solution at 49° C. for 2 minutes;
(d) coating: the test panels were dipped into the cerium treatment solution at room temperature for 1 minute;
(e) rinse: the test panels were rinsed with deionized water for 30 seconds;
(f) drying: the test panels were then dried with a hot air gun for approximately 10 minutes;
(g) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 9.

Example 45

Example 45 represents treatment of a metal substrate involving contacting with an iron phosphate solution followed by treatment with a conversion coating treatment solution.

In particular, in Example 45, cold rolled steel and electrogalvanized panels were treated with the iron phosphate of Example 43, followed by treatment with the conversion coating solution of Example 40, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;
(b) rinsing: the test panels were then rinsed with tap water at room temperature for 15-30 seconds;
(c) coating: the test panels were dipped into the iron phosphate treatment solution at 49° C. for 2 minutes;
(d) coating: the test panels were dipped into the conversion coating treatment solution at room temperature for 2 minutes;
(e) rinse: the test panels were rinsed with deionized water for 30 seconds;
(f) drying: the test panels were then dried with a hot air gun for approximately 10 minutes;
(g) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 9.

Example 46

Example 46 represents treatment of a metal substrate in accordance with the present invention involving contacting with an iron phosphate solution, with a conversion coating treatment solution, and with a cerium solution.

In Example 46, cold rolled steel and electrogalvanized panels were treated with the iron phosphate of Example 43, followed by treatment with the conversion coating solution of Example 40 and the cerium solution of Examples 39-42, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;
(b) rinsing: the test panels were then rinsed with tap water at room temperature for 15-30 seconds;
(c) coating: the test panels were dipped into the iron phosphate treatment solution at 49° C. for 2 minutes;
(d) coating: the test panels were dipped into the conversion coating treatment solution at room temperature for 2 minutes;
(e) coating: the test panels were dipped into the cerium treatment solution at room temperature for 1 minute;
(f) rinse: the test panels were rinsed with deionized water for 30 seconds;
(g) drying: the test panels were then dried with a hot air gun for approximately 10 minutes;
(h) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 9.

Example 47

Example 47 is similar to Example 46 including the same iron phosphate solution, conversion coating treatment solution, and cerium treatment solution, with the coating procedure involving different immersion times, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;
(b) rinsing: the test panels were then rinsed with tap water at room temperature for 15-30 seconds;
(c) coating: the test panels were dipped into the iron phosphate treatment solution at 49° C. for 2 minutes;
(d) coating: the test panels were dipped into the conversion coating treatment solution at room temperature for 1 minute;
(e) coating: the test panels were dipped into the cerium treatment solution at room temperature for 30 seconds;
(f) rinse: the test panels were rinsed with deionized water for 30 seconds;
(g) drying: the test panels were then dried with a hot air gun for approximately 10 minutes;
(h) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 9.

Examples 48-51 demonstrate treatment of metal substrates in accordance with the present invention involving contacting with an iron phosphate solution and with a conversion coating treatment solution, followed by treatment with a cerium treatment solution at varying concentrations and properties.

Example 48

In Example 48, an iron phosphate solution was prepared as in Example 43, and a conversion coating solution was prepared as in Example 40.

Separately, a cerium coating solution was prepared in deionized water, including 3.2 g/l of cerium nitrate, hexahydrate (approx. 1000 ppm Ce). The pH of the solution was adjusted to 2.0 with nitric acid.

Example 49

In Example 49, an iron phosphate solution was prepared as in Example 43, and a conversion coating solution was prepared as in Example 40.

Separately, a cerium coating solution was prepared in deionized water, including 3.2 g/l of cerium nitrate, hexahydrate (approx. 1000 ppm Ce). The pH of the solution was adjusted to 8.0 with ammonium hydroxide.

Example 50

In Example 50, an iron phosphate solution was prepared as in Example 43, and a conversion coating solution was prepared as in Example 40.

Separately, a cerium coating solution was prepared in deionized water, including 0.32 g/l of cerium nitrate, hexahydrate (approx. 100 ppm Ce). The solution was stable with a pH of 4.0.

Example 51

In Example 51, an iron phosphate solution was prepared as in Example 41, and a conversion coating solution was prepared as in Example 40.

Separately, a cerium coating solution was prepared in deionized water, including 16.0 g/l of cerium nitrate, hexahydrate (approx. 5000 ppm Ce). The solution was stable with a pH of 4.0.

Examples 52-54 demonstrate treatment of metal substrates in accordance with the present invention involving contacting with an iron phosphate solution and with a conversion coating treatment solution which includes various additional metals, followed by treatment with a cerium treatment solution.

Example 52

In Example 52, an iron phosphate solution was prepared as in Example 43.

Separately, a conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr and 1200 ppm F) |
| 20.5 g/l | calcium nitrate (approx. 5000 ppm Ca) |
| 1.1 g/l | yttrium nitrate, hexahydrate (approx. 250 ppm Y) |

Also, a cerium coating solution was prepared in as in Examples 39-42.

Example 53

In Example 53, an iron phosphate solution was prepared as in Example 43.

Separately, a conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr and 1200 ppm F) |
| 20.5 g/l | calcium nitrate (approx. 5000 ppm Ca) |
| 2.5 g/l | lanthanum nitrate solution (approx. 1000 ppm La) |

Also, a cerium coating solution was prepared in as in Examples 39-42.

Example 54

In Example 54, an iron phosphate solution was prepared as in Example 43.

Separately, a conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr and 1200 ppm F) |
| 20.5 g/l | calcium nitrate (approx. 5000 ppm Ca) |
| 2.5 g/l | ferrous sulphate, heptahydrate (approx. 250 ppm Fe) |

Also, a cerium coating solution was prepared in as in Examples 39-42.

The compositions of Examples 48-54 were used for the treatment of cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the iron phosphate treatment solution at 49° C. for 2 minutes;

(d) coating: the test panels were dipped into the conversion coating treatment solution at room temperature for 2 minutes;

(e) coating: the test panels were dipped into the cerium treatment solution at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. under the name ED-6650.

Each of the test panels of Examples 43-54 were tested using a 10 day Honda Salt Dip, as is known in the art, to evaluate corrosion resistance. The results are shown in Table 9.

TABLE 9

| | SALT DIP PERFORMANCE (10 DAY) | | | |
|---|---|---|---|---|
| | COLD ROLLED STEEL | | | |
| | AVG. | | ELECTROGALVANIZED | |
| EXAMPLE | CREEP (mm) | MAX. CREEP (mm) | AVG. CREEP (mm) | MAX. CREEP (mm) |
| 43 | 8.6 | 12.8 | 7.1 | 11.3 |
| 44 | 4.1 | 5.3 | 8.1 | 15.5 |
| 45 | 1.5 | 2.5 | 37.8 | 37.8 |
| 46 | 0.5 | 1.0 | 5.2 | 9.2 |
| 47 | 1.5 | 2.7 | 9.3 | 16.7 |
| 48 | 2.7 | 4.8 | 11.3 | 21.2 |
| 49 | 1.2 | 3.5 | 16.4 | 28.5 |
| 50 | 2.5 | 4.3 | 15 | 29.2 |
| 51 | 4.8 | 9.2 | 15 | 23.8 |
| 52 | 1.2 | 2.3 | 8.3 | 13.7 |
| 53 | 1.3 | 2 | 9.4 | 16.3 |
| 54 | 1.5 | 3.2 | 5.7 | 12.8 |

As can be seen from the results shown in Table 9, further contacting of the substrate with an iron phosphate treatment solution prior to application of the conversion coating and/or a cerium treatment solution after application of the conversion coating further improves corrosion resistance. In particular, a comparison of Examples 43 and 44 (which represent panels treated only with an iron phosphate solution, and treated only with an iron phosphate solution and a cerium post treatment, without any conversion coating) with Example 45 (which represents panels treated with an iron phosphate solution followed by treatment with the conversion coatings of the present invention) shows that improved corrosion resistance is imparted for cold rolled steel when an iron phosphate pre-treatment is used with the conversion coatings of the present invention. Also, the results of Examples 46 and 47 (which represent panels treated with an iron phosphate pre-treatment solution prior to application of the conversion coating of the present invention followed by a cerium post treatment) demonstrate the marked improvement in corrosion resistance for both cold rolled steel and electrogalvanized panels, particularly when compared with the results of Example 45 (which represents panels treated with an iron phosphate solution followed by treatment with the conversion coatings of the present invention without any cerium post treatment), as well as with the results of Example 40 (which represents panels treated with the conversion coating of the present invention followed by a cerium post treatment, but without any iron phosphate pre-treatment). Clearly the combination of the iron phosphate pre-treatment, the conversion coating, and the cerium post treatment provides marked improvement in corrosion resistance over any of these components individually.

Examples 55 and 56 demonstrate that incorporating a cerium salt into the aqueous solution of the conversion coating provides further improvement to corrosion resistance.

Examples 55-56

An iron phosphate solution was prepared as in Example 43.

Separately, a conversion coating solution was prepared in deionized water as follows:

The following ingredients were mixed in the order listed below to provide a stable solution with a pH=1.8.

| | |
|---|---|
| 1.0 g/l | Advera 401 (aluminosilicate—zeolite) |
| 6.0 g/l | nitric acid (42 Be) |
| 2.25 g/l | hexafluorozirconic acid (approx. 990 ppm Zr and 1200 ppm F) |
| 20.5 g/l | calcium nitrate (approx. 5000 ppm Ca) |
| 3.2 g/l | cerium nitrate, hexahydrate (approx. 1000 ppm Ce) |

The compositions as prepared were used for the treatment of two sets of cold rolled steel and electrogalvanized panels representing Examples 55 and 56, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the iron phosphate treatment solution at 49° C. for 2 minutes;

(d) coating: the test panels were dipped into the conversion coating treatment solution at room temperature for 2 minutes;

(e) rinse: the test panels were rinsed with deionized water for 30 seconds;

(f) drying: the test panels were then dried with a hot air gun for approximately 10 minutes;

(g) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 10.

TABLE 10

| | SALT DIP PERFORMANCE (10 DAY) | | | |
|---|---|---|---|---|
| | COLD ROLLED STEEL | | | |
| | AVG. | | ELECTROGALVANIZED | |
| EXAMPLE | CREEP (mm) | MAX. CREEP (mm) | AVG. CREEP (mm) | MAX. CREEP (mm) |
| 55 | 1.3 | 2 | 9.7 | 17.7 |
| 56 | 1.7 | 2.7 | 5.1 | 10.5 |

The results of Table 10 demonstrate that including a rare earth metal within the conversion coating treatment solution provides further corrosion resistance. For example, a comparison of Examples 55-56 with Example 45 demonstrates that test panels treated with an iron phosphate treatment solution followed by treatment with a conversion coating of the present invention including a cerium salt provides better corrosion resistance as compared with test panels treated with an iron phosphate treatment solution followed by treatment with a conversion coating of the present invention which does not include a cerium salt, with a drastic change in the corrosion resistance for electrogalvanized panels.

Examples 57-66 demonstrate results achieved with conversion coatings according to the present invention including silicon as the central atom of the complex metal fluoride compound, with or without iron phosphate pre-treatments and cerium post-treatments.

Example 57

A conversion coating solution was prepared in deionized water as follows:

The following ingredients were mixed in the order listed below to provide a stable solution with a pH=1.7.

| | |
|---|---|
| 4.0 g/l | hexafluorosilicic acid (approx. 780 ppm Si and 3200 ppm F) |
| 32.8 g/l | calcium nitrate(approx. 8000 ppm Ca) |
| 0.25 g/l | Advera 401 (aluminosilicate—zeolite) |

Example 58

A conversion coating solution was prepared in deionized water as follows:

The following ingredients were mixed in the order listed below to provide a stable solution with a pH=1.4.

| | |
|---|---|
| 4.0 g/l | hexafluorosilicic acid (approx. 780 ppm Si and 3200 ppm F) |
| 16.4 g/l | calcium nitrate(approx. 4000 ppm Ca) |
| 0.25 g/l | Advera 401 (aluminosilicate—zeolite) |

The compositions of Examples 57-58 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the conversion coating treatment solution, of the examples, at room temperature for 2 minutes;

(d) rinse: the test panels were rinsed with deionized water for 30 seconds;

(e) drying: the test panels were then dried with a hot air gun for approximately 10 minutes;

(f) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 11.

Example 59

A conversion coating solution was prepared in deionized water as follows:

The following ingredients were mixed in the order listed below to provide a stable solution with a pH=1.7.

| | |
|---|---|
| 4.0 g/l | hexafluorosilicic acid (approx. 800 ppm Si and 3200 ppm F) |
| 32.8 g/l | calcium nitrate(approx. 8000 ppm Ca) |
| 0.25 g/l | Advera 401 (aluminosilicate—zeolite) |

Separately, a cerium coating solution was prepared in deionized water, including 1.6 g/l of cerium nitrate, hexahydrate (approx. 500 ppm Ce). The solution was stable with a pH of 4.0.

Example 60

A conversion coating solution was prepared in deionized water as follows:

The following ingredients were mixed in the order listed below to provide a stable solution with a pH=1.4.

| | |
|---|---|
| 4.0 g/l | hexafluorosilicic acid (approx. 800 ppm Si and 3200 ppm F) |
| 16.4 g/l | calcium nitrate(approx. 4000 ppm Ca) |
| 0.25 g/l | Advera 401 (aluminosilicate—zeolite) |

Separately, a cerium coating solution was prepared in deionized water, including 6.2 g/l of cerium nitrate, hexahydrate (approx. 2000 ppm Ce). The solution was stable with a pH of 4.0.

Example 61

A conversion coating solution was prepared in deionized water as follows:

The following ingredients were mixed in the order listed below to provide a stable solution with a pH=2.0.

| | |
|---|---|
| 10.0 g/l | hexafluorosilicic acid (approx. 1,100 ppm Si and 8000 ppm F) |
| 20.5 g/l | calcium nitrate(approx. 5000 ppm Ca) |

Separately, a cerium coating solution was prepared as in Example 60.

Example 62

A conversion coating solution was prepared in deionized water as follows:

The following ingredients were mixed in the order listed below to provide a stable solution with a pH=1.8.

| | |
|---|---|
| 2.0 g/l | hexafluorosilicic acid (approx. 390 ppm Si and 1,600 ppm F) |
| 8.2 g/l | calcium nitrate (approx. 2,000 ppm Ca) |

Separately, a cerium coating solution was prepared in deionized water, including 6.2 g/l of cerium nitrate, hexahydrate (approx. 2000 ppm Ce). The solution was stable with a pH of 5.6.

Example 63

A conversion coating solution was prepared in deionized water as follows:

The following ingredients were mixed in the order listed below to provide a stable solution with a pH=1.8.

| | |
|---|---|
| 2.0 g/l | hexafluorosilicic acid (approx. 390 ppm Si and 1,600 ppm F) |
| 8.2 g/l | calcium nitrate (approx. 2,000 ppm Ca) |

-continued

| | |
|---|---|
| 1.0 g/l | sodium polysilicate (approx. 1,000 ppm $Na_2Si_3O_7$ $xH_20$) |
| 0.4 g/l | tin (II) chloride dihydrate (aprrox. 200 ppn Sn(II)) |

Separately, a cerium coating solution was prepared as in Example 62.

Example 64

A conversion coating solution was prepared in deionized water as follows:

The following ingredients were mixed in the order listed below to provide a stable solution with a pH=1.3.

| | |
|---|---|
| 4.0 g/l | hexafluorosilicic acid (approx. 780 ppm Si and 3,200 ppm F) |
| 32.8 g/l | calcium nitrate (approx. 8,000 ppm Ca) |
| 0.25 g/l | Advera 401 (aluminosilicate—zeolite) |

Separately, a cerium coating solution was prepared in deionized water, including 6.2 g/l of cerium nitrate, hexahydrate (approx. 2000 ppm Ce). The solution was stable with a pH of 5.0.

The compositions of Examples 59-64 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the conversion coating treatment solution, of the examples, at room temperature for 2 minutes;

(d) coating: the test panels were dipped into the cerium treatment solution, of the examples, at room temperature for 1 minute;

(e) rinse: the test panels were rinsed with deionized water for 30 seconds;

(f) drying: the test panels were then dried with a hot air gun for approximately 10 minutes;

(g) electrocoat: the test panels were painted with a lead-free cathodic electrocoating composition, available from PPG Industries, Inc. under the name ED-6650.

Each of the test panels coated as such were tested using a 10 day Honda Salt Dip, as is known in the art, to evaluate corrosion resistance. The results are shown in Table 11.

Example 65

An iron phosphate was prepared in tap water as follows:

| | |
|---|---|
| 40 ml/l | Chemfos 51 (available from PPG Industries, Inc.) |
| 0.3 g/l | ammonium bifluoride |
| 1.5 ml/l | Chemfil Buffer (available from PPG Industries, Inc.) pH = 3.9 |

A conversion coating solution was prepared in deionized water as follows:

The following ingredients were mixed in the order listed below to provide a stable solution with a pH=1.6.

| | |
|---|---|
| 4.0 g/l | hexafluorosilicic acid (approx. 780 ppm Si and 3,200 ppm F) |
| 7.7 g/l | calcium nitrate (approx. 1,500 ppm Ca) |

Separately, a cerium coating solution was prepared in deionized water, including 1.6 g/l of cerium nitrate, hexahydrate (approx. 500 ppm Ce).

Example 66

An iron phosphate was prepared as in Example 65.

Separately, a conversion coating solution was prepared in deionized water as follows:

The following ingredients were mixed in the order listed below to provide a stable solution with a pH=1.6.

| | |
|---|---|
| 4.0 g/l | hexafluorosilicic acid (approx. 780 ppm Si and 3,200 ppm F) |
| 32.8 g/l | calcium nitrate (approx. 8,000 ppm Ca) |
| 0.25 g/l | Advera 401 (aluminosilicate—zeolite) |

Separately, a cerium coating solution was prepared in deionized water, including 1.6 g/l of cerium nitrate, hexahydrate (approx. 500 ppm Ce).

The compositions of Examples 65-66 were used as conversion coatings for treating cold rolled steel and electrogalvanized panels, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the iron phosphate treatment solution at 49° C. for 2 minutes;

(d) coating: the test panels were dipped into the conversion coating treatment solution, of the examples, at room temperature for 2 minutes;

(e) coating: the test panels were dipped into the cerium treatment solution, of the examples, at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. under the name ED-6650.

Each of the test panels of Examples 57-66 were tested using a 10 day Honda Salt Dip, as is known in the art, to evaluate corrosion resistance. The results are shown in Table 11.

TABLE 11

| | SALT DIP PERFORMANCE (10 DAY) | | | |
|---|---|---|---|---|
| | COLD ROLLED STEEL | | | |
| | AVG. | | ELECTROGALVANIZED | |
| EXAMPLE | CREEP (mm) | MAX. CREEP (mm) | AVG. CREEP (mm) | MAX. CREEP (mm) |
| 57 | 7.5 | 15.3 | 3.7 | 11.2 |
| 58 | 7.6 | 23.2 | 7.2 | 16.7 |

TABLE 11-continued

| | SALT DIP PERFORMANCE (10 DAY) | | | |
|---|---|---|---|---|
| | COLD ROLLED STEEL | | | |
| | AVG. | | ELECTROGALVANIZED | |
| EXAMPLE | CREEP (mm) | MAX. CREEP (mm) | AVG. CREEP (mm) | MAX. CREEP (mm) |
| 59 | 3.8 | 5.7 | 3.6 | 9.0 |
| 60 | 2.0 | 4.5 | 8.7 | 17.3 |
| 61 | 5.2 | 7.9 | 5.8 | 11.2 |
| 62 | 4.7 | 10.0 | 6.1 | 12.0 |
| 63 | 6.2 | 10.1 | 4.4 | 9.7 |
| 64 | 3.8 | 6.2 | 2.6 | 5.0 |
| 65 | 5.4 | 7.0 | 7.5 | 15.3 |
| 66 | 4.0 | 6.7 | 7.8 | 15.3 |

The results of Table 11 demonstrate that conversion coatings including silicon provide improved corrosion resistance over prior art conversion coatings, particularly when used with iron phosphate pre-treatment solutions and/or cerium post-treatment solutions.

Examples 67-69

Examples 68 and 69 represent treatment of a metal substrate in accordance with the present invention involving contacting the substrate with an iron phosphate solution containing stannous ion, followed by contacting with a conversion coating treatment solution, and then with a cerium-containing solution. Comparative Example 67 represents the analogous treatment of a metal substrate where the iron phosphate solution does not contain stannous ion.

Comparative Example 67

For this example, cold rolled steel and electrogalvanized test panels were treated with the iron phosphate of Example 43, followed by treatment with the conversion coating solution of Example 40, and then with the cerium solution of Examples 39-42, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;
(b) rinsing: the test panels were then rinsed with tap water at room temperature for 15-30 seconds;
(c) coating: the test panels were dipped into the iron phosphate treatment solution at 49° C. for 2 minutes;
(d) coating: the test panels were dipped into the conversion coating treatment solution at room temperature for 2 minutes;
(e) coating: the test panels were dipped into the cerium treatment solution at room temperature for 1 minute;
(f) rinse: the test panels were rinsed with deionized water for 30 seconds;
(g) drying: the test panels were then dried with a hot air gun for approximately 10 minutes;
(h) electrocoat: the test panels were painted with a lead-free cathodic electrocoating composition, available from PPG Industries, Inc. as ED-6650.

Example 68

This example describes the preparation of an iron phosphate solution from an admixture of the following ingredients in tap water as follows:

| | |
|---|---|
| 40 ml/l | CHEMFOS 51 (available from PPG Industries, Inc.) |
| 0.3 g/l | ammonium bifluoride |
| 1.5 ml/l | CHEMFIL Buffer (available from PPG Industries, Inc.) |
| 0.2 g/l | stannous chloride, dihydrate |

The resulting solution had a pH of 3.5.

Cold rolled steel and electrogalvanized test panels were treated with this iron phosphate solution, followed by treatment with the conversion coating solution of Example 40, and then the cerium solution of Examples 39-42, as follows:

(a) degreasing: the test panels were first cleaned using an alkaline degreasing agent (CHEMKLEEN 163 available from PPG Industries, Inc.) at 2% by volume, which was sprayed on to the metal substrates at 60° C. for 1 minute;
(b) rinsing: the test panels were then rinsed with tap water at room temperature for 15-30 seconds;
(c) coating: the test panels were dipped into the iron phosphate treatment solution at 49° C. for 2 minutes;
(d) coating: the test panels were dipped into the conversion coating treatment solution at room temperature for 2 minutes;
(e) coating: the test panels were dipped into the cerium treatment solution at room temperature for 1 minute;
(f) rinse: the test panels were rinsed with deionized water for 30 seconds;
(g) drying: the test panels were then dried with a hot air gun for approximately 10 minutes;
(h) electrocoat: the test panels were painted with a lead-free cathodic as ED-6650;

Example 69

This example describes the preparation of an iron phosphate solution from an admixture of the following ingredients in tap water as follows:

| | |
|---|---|
| 40 ml/l | CHEMFOS 51 (available from PPG Industries, Inc.) |
| 0.3 g/l | ammonium bifluoride |
| 1.5 ml/l | CHEMFIL Buffer (available from PPG Industries, Inc.) |
| 0.1 g/l | stannous chloride, dihydrate |

The resulting solution had a pH of 3.5.

Cold rolled steel and electrogalvanized test panels were treated with this iron phosphate solution, followed by treatment with the conversion coating solution of Example 40, and then the cerium solution of Examples 39-42, as follows:

(a) degreasing: the test panels were first cleaned using an alkaline degreasing agent ("Chemkleen 163" available from PPG Industries, Inc. at 2% by volume) which was sprayed on to the metal substrates at 60° C. for 1 minute;
(b) rinsing: the test panels were then rinsed with tap water at room temperature for 15-30 seconds;
(c) coating: the test panels were dipped into the iron phosphate treatment solution at 49° C. for 2 minutes;
(d) coating: the test panels were dipped into the conversion coating treatment solution at room temperature for 2 minutes;
(e) coating: the test panels were dipped into the cerium treatment solution at room temperature for 1 minute;
(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. as ED-6650;

Each of the test panels coated as described above were tested for corrosion resistance using test method SAE J2334 (80 cycle), as is known in the art. The test results are presented in the following Table 12.

TABLE 12

| | Corrosion Resistance: SAE J2334 (80 cycle) | | | |
|---|---|---|---|---|
| | COLD ROLLED STEEL | | ELECTROGALVANIZED | |
| EXAMPLE | Avg. Creep (mm) | Max. Creep (mm) | Avg. Creep (mm) | Max. Creep (mm) |
| 67* | 6.3 | 9.2 | 2.4 | 3.8 |
| 68 | 6.7 | 9.0 | 2.3 | 3.7 |
| 69 | 5.3 | 9.3 | 2.8 | 3.8 |

*Comparative

Examples 70-72

Examples 71 and 72 represent treatment of a metal substrate in accordance with the present invention involving contacting with an iron phosphate solution containing stannous ion, followed by contacting with a conversion coating treatment solution, and then with a cerium solution. Comparative Example 70 represents analogous treatment of a metal substrate where the iron phosphate solution does not contain stannous ion.

Comparative Example 70

Cold rolled steel and electrogalvanized test panels were treated with the iron phosphate of Example 43, followed by treatment with the conversion coating solution of Example 40, and then the cerium solution of Examples 39-42, as follows:

(a) degreasing: the test panels were first cleaned using an alkaline degreasing agent "CHEMKLEEN 163 available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the iron phosphate treatment solution at 49° C. for 2 minutes;

(d) coating: the test panels were dipped into the conversion coating treatment solution at room temperature for 2 minutes;

(e) coating: the test panels were dipped into the cerium treatment solution at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. as ED-6650;

(i) topcoat: the test panels were then painted with a topcoat system primer/base/clear (DPX 1809 B-1/HWB 83542 B-1/DCT 50002H, all available from PPG Industries, Inc.)

Example 71

This example describes the preparation of an iron phosphate solution from an admixture of the following ingredients in tap water as follows:

| | |
|---|---|
| 40 ml/l | CHEMFOS 51 (available from PPG Industries, Inc.) |
| 0.3 g/l | ammonium bifluoride |
| 1.5 ml/l | CHEMFIL Buffer (available from PPG Industries, Inc.) |
| 0.2 g/l | stannous chloride, dihydrate |

The resulting solution had a pH of 3.5.

Cold rolled steel and electrogalvanized test panels were treated with this iron phosphate solution, followed by treatment with the conversion coating solution of Example 40, and then the cerium solution of Examples 39-42, as follows:

(a) degreasing: the test panels were first cleaned using an alkaline degreasing agent (CHEMKLEEN 163 available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the iron phosphate treatment solution at 49° C. for 2 minutes;

(d) coating: the test panels were dipped into the conversion coating treatment solution at room temperature for 2 minutes;

(e) coating: the test panels were dipped into the cerium treatment solution at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. as ED-6650;

(i) topcoat: the test panels were painted with a topcoat system primer/base/clear (DPX 1809 B-1/HWB 83542 B-1/DCT 50002H all available from PPG Industries, Inc.)

Example 72

This example describes the preparation of an iron phosphate solution from an admixture of the following ingredients in tap water as follows:

| | |
|---|---|
| 40 ml/l | CHEMFOS 51 (available from PPG Industries, Inc.) |
| 0.3 g/l | ammonium bifluoride |
| 1.5 ml/l | CHEMFIL Buffer (available from PPG Industries, Inc.) |
| 0.1 g/l | stannous chloride, dihydrate |

The resulting solution had a pH of 3.5.

Cold rolled steel and electrogalvanized test panels were treated with this iron phosphate solution, followed by treatment with the conversion coating solution of Example 40, and then the cerium solution of Examples 39-42, as follows:

(a) degreasing: the test panels were first cleaned using an alkaline degreasing agent (CHEMKLEEN 163 available from PPG Industries, Inc. at 2% by volume) which was sprayed on to the metal substrates at 60° C. for 1 minute;

(b) rinsing: the test panels were then rinsed with tap water at room temperature for 15-30 seconds;

(c) coating: the test panels were dipped into the iron phosphate treatment solution at 49° C. for 2 minutes;

(d) coating: the test panels were dipped into the conversion coating treatment solution at room temperature for 2 minutes;

(e) coating: the test panels were dipped into the cerium treatment solution at room temperature for 1 minute;

(f) rinse: the test panels were rinsed with deionized water for 30 seconds;

(g) drying: the test panels were then dried with a hot air gun for approximately 10 minutes;

(h) electrocoat: the test panels were painted with a lead-free cathodic electrocoating composition, available from PPG Industries, Inc. as ED-6650;

(i) topcoat: the test panels were painted with a topcoat system primer/base/clear (DPX 1809 B-1/HWB 83542 B-1/DCT 50002H, all available from PPG Industries, Inc.).

Each of the test panels prepared as described above were tested using test method GM9071 P, as is known in the art, to evaluate paint adhesion. The results are presented in the following Table 13.

TABLE 13

| | Adhesion Test Method: GM9071P | |
|---|---|---|
| EXAMPLE | COLD ROLLED STEEL Paint loss (%) | ELECTROGALVANIZED Paint loss (%) |
| 70* | <5 | 25-30 |
| 71 | <5 | <5 |
| 72 | <5 | <5 |

*Comparative

The test results presented in Tables 12 and 13 above illustrate that the inclusion of stannous ion in the iron phosphate solutions useful in the methods of the present invention, provide enhanced paint adhesions without impacting corrosion resistance of the subsequently applied coating systems.

While the invention has been described in terms of preferred embodiments, it is to be understood that various modifications thereof will become apparent to those skilled in the art upon reading the specification. Therefore, it is to be understood that the invention disclosed herein is intended to encompass such modifications as fall within the scope of the appended claims.

What is claimed is:

1. A coated metal substrate comprising a metal surface which has been contacted with an aqueous crystalline-forming composition comprising a Group IIA dissolved metal ion; a dissolved complex metal fluoride ion wherein the metal atom is selected from Group IIIA, Group IVA, Group IVB, Group VA, and Group VB metals; a complex forming metal salt different from the complex metal fluoride ion, and water, wherein the complex forming metal salt complexes free fluoride ions to provide an aqueous composition which is substantially free of Group IIA metal fluoride precipitate; and wherein the complex forming metal salt is selected from the group consisting of sodium metasilicate, polysilicate, Zeolites, zirconyl nitrate, titanyl sulfate, tetrafluorozirconate, tetrafluorotitanate.

2. The coated metal substrate according to claim 1, wherein the metal atom of said dissolved complex metal fluoride ion is selected from the group consisting of silicon, zirconium, and titanium.

3. The coated metal substrate according to claim 1, wherein the Zeolites comprises aluminosilicates.

4. The coated metal substrate according to claim 1, wherein said Group IIA dissolved metal ion comprises a metal atom selected from the group consisting of calcium, magnesium, beryllium, strontium, and barium.

5. The coated metal substrate according to claim 4, wherein said Group IIA dissolved metal ion is calcium.

6. The coated metal substrate as in claim 1, wherein said metal surface has been contacted with a phosphate-based composition prior to having been contacted with said aqueous crystalline-forming composition.

7. The coated metal substrate according to claim 6, wherein the phosphate-based composition is iron phosphate.

8. The coated metal substrate as in claim 1, wherein said metal surface has been contacted with an aqueous rare earth metal salt solution after having been contacted with said aqueous crystalline-forming composition.

9. The coated metal substrate according to claim 8, wherein said aqueous rare earth metal salt solution comprises an acidic salt of a rare earth metal.

10. The coated metal substrate according to claim 9, wherein said rare earth metal is cerium.

11. The coated metal substrate according to claim 9, wherein said aqueous rare earth metal solution comprises cerium nitrate.

12. The coated metal substrate according to claim 9, wherein the aqueous rare earth metal salt solution comprises a rare earth metal ion; and wherein the rare earth metal ion is present in the salt solution in an amount ranging from about 50 to about 5,000 parts per million rare earth metal ion.

* * * * *